United States Patent [19]

Haswell, Jr. et al.

[11] Patent Number: 4,640,814

[45] Date of Patent: Feb. 3, 1987

[54] METHOD FOR PRODUCING CLAD TUBULAR PRODUCT

[75] Inventors: Walter T. Haswell, Jr., Jamesville, N.Y.; Karl S. Brosius, Burgettstown; Scott B. Justus, Wexford, both of Pa.; David A. Salvatora, Gibsonia, Pa.

[73] Assignee: Crucible Materials Corporation, Pittsburgh, Pa.

[21] Appl. No.: 788,413

[22] Filed: Oct. 17, 1985

[51] Int. Cl.[4] ..... B22F 7/00

[52] U.S. Cl. ..... 419/8; 419/38; 419/48; 419/51; 419/66; 428/558; 428/553; 264/120; 264/125

[58] Field of Search ..... 419/8, 41, 48, 51, 66, 419/120, 125; 264/209.1, 313, 317, 319, 323, DIG. 50; 427/239; 425/78; 428/558, 553

[56] References Cited

U.S. PATENT DOCUMENTS

| | | | |
|---|---|---|---|
| 3,066,403 | 12/1962 | Brauchler | 419/8 X |
| 3,753,704 | 8/1973 | Manilla et al. | 419/8 |
| 4,362,563 | 12/1982 | Stadler et al. | 419/5 |

*Primary Examiner*—Stephen J. Lechert, Jr.
*Assistant Examiner*—S. Wolffe
*Attorney, Agent, or Firm*—Finnegan, Henderson, Farabow, Garrett & Dunner

[57] ABSTRACT

A powder-metallurgy method for producing tubular product having at least one surface and preferably an internal surface thereof clad with an alloy different from and preferably more resistant to destructive media than the material from which the remainder of the tubing is constructed. An assembly is constructed of a metal tubing having an internal surface to be clad and a tubular insert mounted generally axially within the tubing in spaced-apart relation to the internal surface thereof, which provides a generally annular cavity between the internal surface of the tubing and the tubular insert. This cavity is filled with metal particles of a composition to be clad on the tubing internal surface. The cavity is sealed and the assembly is heated to an elevated temperature at which it is forged to compact the metal particles introduced to the cavity to substantially full density and metallurgically bond the particles to the internal surface of the tubing to provide a desired destructive-media resistant cladding. The forging operation includes passing the assembly along a feed path having an axis through a forging box having a plurality of hammers evenly spaced around the assembly. The hammers extend and retract radially with respect to the feedpath axis to impart a radial forging action to the assembly as the assembly passes through the forging box.

11 Claims, 2 Drawing Figures

METHOD FOR PRODUCING CLAD TUBULAR PRODUCT

BACKGROUND OF THE INVENTION

In applications, such as oil well drilling, the petrochemical industry and geothermal installations, there is a need for tubing that is highly resistant to the destructive media of substances flowing through the tubing. This destructive media, depending upon the particular application, may include corrosive media, abrasive media, high-temperature media and combnations thereof. For these applications it is known to use monolithic tubing of alloys that are highly resistant to destructive media, which would include nickel-base alloys, such as INCO 625. With monolithic tubing constructed from conventional alloys of this type, the cost of the finished tubing is typically on the order of $50 per foot, and the cost may be much higher for large - diameter tubing. This adds considerably to the overall cost of installations with which tubing of this type is employed.

SUMMARY OF THE INVENTION

It is accordingly a primary object of the present invention to provide a method for producing tubular product having at least one clad surface, and preferably an interior surface, of a conventional alloy different from and preferably resistant to destructive media with the remainder of the tubing being constructed from a different material that is preferably less resistant to destructive media, and thus a lower cost material; in this manner, tubing suitable for use in applications embodying destructive media may be produced at a much lower cost than using monolithic tubing of the required destructive-media resistant alloy.

A more specific object of the invention is to provide a mehtod for producing internally clad tubing suitable for use in destructive-media applications wherein internal cladding is provided by a powder-mettalurgy practice wherein metal particles of the desired destructive-media resistant alloy are used to clad the internal surface of the tubing by a forging operation to compact the metal particles to substantially full density and metallurgically bond them to the internal surface of the tubing.

In accordance with these objects, and broadly in accordance with the invention, the method thereof for producing tubular product having on at least one surface thereof and preferably an internal surface, cladding of an alloy different from and prefereably more resistant to destructive-media than the interior surface to be clad comprises constructing an assembly including a metal tubing having an internal surface to be clad, a tubular insert mounted generally axially within said tubing in spaced-apart relation to the internal surface thereof to provide a generally annular cavity between said internal surface and said tubular insert. This cavity is filled with metal particles of a composition different from and preferably more resistant to the destructive-media than the surface to be clad or the remainder of the tubing. The assembly is heated to an elevated temperature and forged to compact the metal particles to substantially full density and metallurgically bond the particles to the internal surface, whereby cladding is produced on the surface of the tubing and preferably on an internal surface. During the forging operation, the metal tubing may be elongated. The assembly may include for sealing the powder-filled cavity, two annular rings each connected in sealing engagement between adjacent ends of the tubing and the tubular insert at opposite ends of the assembly. The cavity may be filled with metal particles through at least one stem that extends into the annular cavity. The stem is adapted for sealing prior to forging. The stem may extend through one of the annular rings and, after filling the annular cavity with metal particles and prior to forging, the cavity is sealed by crimping the stem and connecting an annular cap in sealing engagement between adjacent ends of the tubing and the insert and over the crimped stem.

Further in accordance with the invention, the assembly is forged by the use of a mandrel extending within the assembly which is moved along a feed path having an axis through a forging box. The forging box has a plurality of hammers evenly spaced around the assembly. The hammers are adapted to simultaneously extend and retract radially relative to the axis to impart a radial forging action to the assembly as the assembly passes through the forging box. This forging action is of a magnitude and duration to compact the particles to substantially full density and metallurgically bond the particles to the internal surface of the tubing.

DETAILED DESCRIPTION OF THE INVENTION

Figure 1:
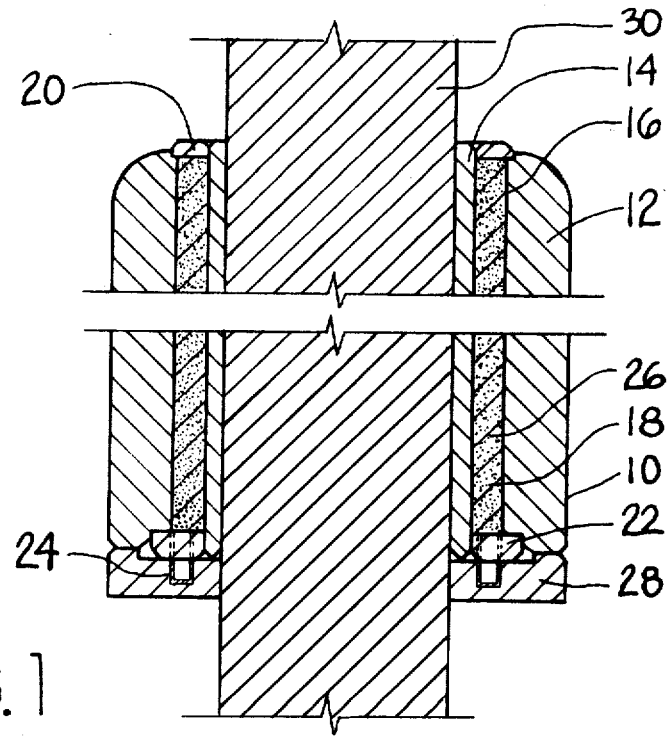
FIG. 1 is a sectional view of one embodiment of an assembly suitable for use in the method of the invention for producing a metal tubular product having an internal surface clad with an alloy of a metallurgical composition different than the surface being clad or the remainder of the tubing.

With reference to the drawings, and for the present to FIG. 1, there is shown an assembly in accordance with the invention and suitable for use in the practice of the method thereof. The assembly, generally designated as 10, includes a tubing 12, which may be of an alloy that is less resistant to destructive media than required for a particular application. Typically, the tubing may be alloy steel or plain carbon steel. The only requirement with regard to the material from which the tubing is constructed is that it be forgable. Positioned generally axially within said tubing 12 and having a diameter less than the internal diameter of the tubing 12 is a tubular insert 14. The tubular insert 14 may be constructed from the same material as the tubing 12, but this is not a requirement. The insert 14, as shown in FIG. 1, is in spaced-apart relation from internal surface 16 of the tubing 12. The area between insert 14 and internal surface 16 of tubing 12 constitutes an annular cavity 18. An annular metal ring 20 is connected in sealing engagement, as by welding (not shown), between adjacent ends of the tubing 12 and insert 14 at one end of the assembly 10. The annular ring 20 in this manner seals the end of the cavity 18 at which it is connected. At the opposite end of the cavity 18 from the ring 20 there is provided a second annular ring 22 that is similarly connected in sealing engagement between adjacent ends of the tubing and the tubular insert. The annular rings 20 and 22 are constructed of metal which may be the same as that of insert 14. Two identical metal stems 24 extend into the cavity 18. Metal particles, designated as 26, are introduced to the cavity 18 through stems 24. The metal particles are of a composition different than the tubing surface to be clad, and preferably of a material that is more resistant to destructive media than the material of the surface to be clad. Although two stems are shown for this purpose in FIG. 1, any suitable number may be employed. The stems 24 extend through annular ring 22. After filling the annular cavity 18 with metal particles 26 introduced through the stems 24, the stems are crimped, with is the configuration shown in FIG. 1 and an annular cap 28 is connected in sealing engagement between adjacent ends of the tubing and insert and over the crimped stems. The cap is connected as by welding (not shown) to tubing 12 and ring 22. In this manner, the end of the cavity 18 opposite that of ring 20 is likewise sealed after filling of the cavity with the metal particles 26.

The assembly 10 after filling of the cavity 18 thereof with metal particles and sealed as shown in the drawing, is heated to a temperature for forging which temperature is typically within the range of 1000° to 2200° F.

Figure 2:
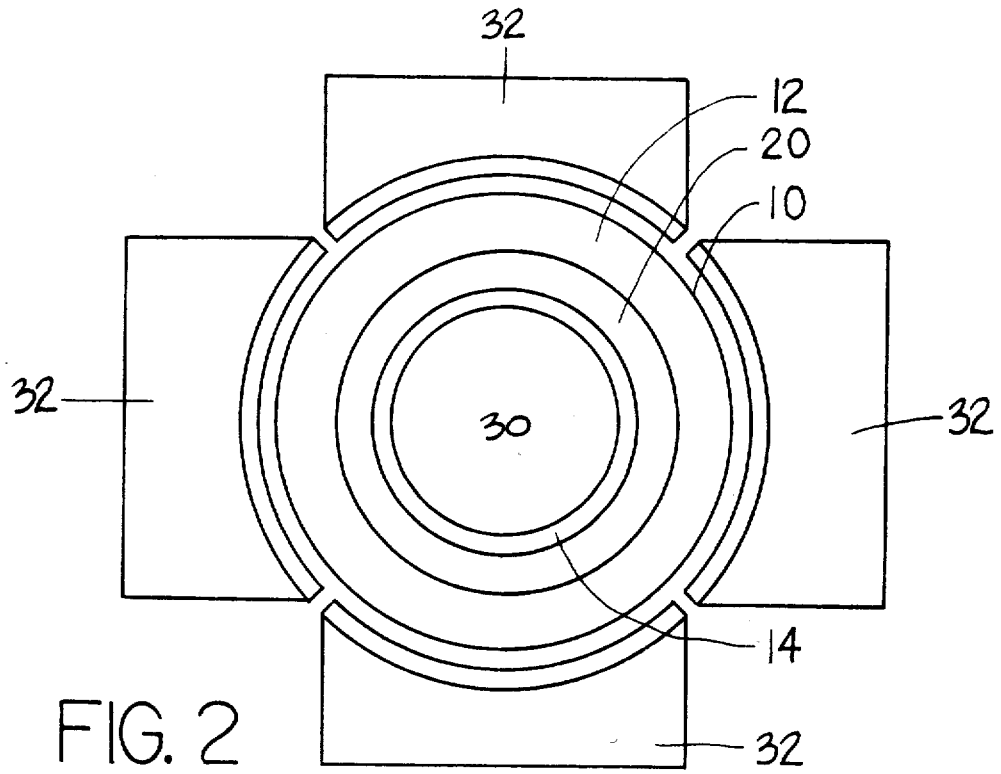
FIG. 2 is an end view of the assembly of FIG. 1 showing schematically forging hammers and a mandrel in accordance with the method of the invention as applied to the assembly in the practice of the method of the invention.

The assembly is forged by placing a mandrel 30 longitudinally within insert 14, as shown in FIG. 1 and 2. Preferably, the forging box has four hammers 32 which are evenly spaced around the assembly, as shown in FIG. 2. The hammers strike simultaneously at a rate of 175 to 200 times per minute. In this manner, the circumference of the assembly as it moves longitudinally through the forging box is subjected to an all-sided, sequential forging operation with the mandrel supporting the assembly and over which the tubing is elongated. The forging operation provides for uniform, rapid forging along the entire circumference of the assembly so that full density and metallurgical bonding of the particles to the tubing interior is achieved. The apparatus suitable for use with the practice of the invention may be that described in Kralawetz U.S. Pat. No. 3,165,012. The forging machine of this patent has four hammers that are radially directed toward the axis of the workpiece, which workpiece is moved longitudinally through a forging box embodying the hammers which are driven by driving shafts eccentrically mounted to cause the hammers to perform a reciprocating, sequential forging action. During forging, and incident to this compacting and bonding operation, the tubing may be elongated about two to ten times its original length.

After forging the annular rings 20 and 22 and cap 28 may be removed to provide a tubing having the desired interior clad surface. Likewise, insert 14 may be removed by a machining operation which may be chemical or mechanical or by a combination of chemical and mechanical action. There may be applications wherein the insert may remain on the compacted tubing. The insert is bonded to the compacted particles 26 during the extrusion operation.

The metal particles 26 may be produced by any of the well known practices for manufacturing powder particles suitable for powder-metallurgy applications. One preferred practice, however, is to gas atomize a molten metal stream to produce discrete prealloyed particles which are rapidly cooled within a protective atmosphere and collected for use.

It is to be understood that the term "metal" as used in the specification and claims includes alloys as well as carbides, such as tungsten carbides and the like and the terms "metal" and "alloy" are used interchangably. The metal particles in applications requiring resistance to a highly abrasive media may be particles of carbides, such as tungsten carbides, which are highly resistant to abrasion.

Although the invention has been described and claimed with respect to cladding "tubing", it is to be understood that various cylindrical products could be made by the practice of the invention which might be used in other than tubing applications.

Prior to forging and incident to the heating operation of the assembly, the cavity 18 of the assembly may be connected through stems 24 to a pump which may be used to evacuate the chamber interior to remove deleterious gaseous-reaction products prior to sealing the cavity, which operation is conventionally termed "outgassing."

What is claimed is:

1. A powder-metallurgy method for producing tubular product having on a metal surface thereof a cladding of an alloy of a metallurgical composition different from said surface, said method comprising constructing an assembly including a metal tubing having at least one surface to be clad, a tubular insert mounted generally axially with said tubing in spaced-apart relation to said surface to provide a generally annular cavity between said surface and said tubular insert, filling said cavity with metal particles of a metallurgical composition different from said surface, sealing said powder-filled cavity, heating said assembly to an elevated temperature and simultaneously forging said assembly to compact said metal particles to substantially full density and metallurgically bond said particles to said surface, said forging including passing said assembly along a feed path having an axis through a forging box having a plurality of hammers evenly spaced around said assembly and adapted to extend and retract radially with respect to said axis to impart a radial forging action to said assembly as said assembly passes through said forging box.

2. The method of claim 1 wherein said tubing is elongated during said forging over a mandrel.

3. The method of claim 1 wherein said assembly includes for sealing said powder-filled cavity two annular rings, each connected in sealing engagement between adjacent ends of said tubing and tubular insert at opposite ends of said assembly.

4. The method of claim 1 wherein said assembly includes as least one stem extending into said annular cavity through which said metal particles are introduced during filing of said cavity therewith, said stem being adapted for sealing prior to forging.

5. The method of claim 1 wherein said stem extends through one of said annular rings and after filling said annular cavity with said metal particles and prior to forging said cavity is sealed by crimping said stem and connecting an annular cap in sealing engagement between adjacent ends of said tubing and said insert and over said crimped stem.

6. A powder-metallurgy method for producing tubular product having on an internal surface thereof an internal cladding of an alloy more resistant to destructive media than said internal surface, said method comprising constructing an assembly including a metal tubing having an internal surface, a tubular insert mounted generally axially within said tubing in spacedapart relation to said internal surface thereof to provide a generally annular cavity between said internal surface and said tubular insert, filling said cavity with metal particles of a composition more resistant to destructive media than said internal tubing surface, sealing said powder-filled cavity, heating said assembly to an elevated temperature and simultaneously forging said assembly to compact said metal particles to substantially full density and metallurgically bond said particles to said internal surface, said forging including passing said assembly along a feed path having an axis through a forging box having a plurality of hammers evenly spaced around said assembly and adapted to extend and retract radially with respect to said axis to impart a radial forging action to said assembly as said assembly passes through said forging box.

7. The method of claim 6 wherein said tubing is elongated during said forging over a mandrel.

8. The method of claim 6 wherein said assembly includes for sealing said powder-filled cavity two annular rings, each connected in sealing engagement between adjacent ends of said tubing and said tubular insert at opposite ends of said assembly.

9. The method of claim 6 wherein said assembly includes at least one stem extending into said annular cavity through which said metal particles are introduced during filling of said cavity therewith, said stem being adapted for sealing prior to said extruding.

10. The method of claim 6 wherein said stem extends through one of said annular rings and after filling said annular cavity with said metal particles and prior to said extruding said cavity is sealed by crimping said stem and connecting an annular cap in sealing engagement between adjacent ends of said tubing and said insert and over said crimped stem.

11. A powder-metallurgy method for producing tubular product having on an internal surface thereof an internal cladding of an alloy more resistant to destructive media than said internal surface, said method comprising constructing an assembly including a metal tubing having an internal surface, a tubular insert mounted generally axially within said tubing in spaced-apart relation to said internal surface thereof to provide a generally annular cavity between said internal surface and said tubular insert, filling said cavity with metal particles of a composition more resistant to destructive media than said internal tubing surface through at least one stem extending into said annular cavity, sealing said cavity by connecting in sealing engagement two annular rings between adjacent ends of said tubing and said insert at opposite ends of said assembly, crimping said stem and connecting an annular cap in sealing engagement between adjacent ends of said tubing and said insert and over said crimped stem, heating said assembly to elevated temperature and simultaneously forging said assembly to compact said metal particles to substantially full density, metallurgically bond said particles to said internal surface and elongate said tubing, said forging including passing said assembly along a feed path having an axis through a forging box having a plurality of hammers evenly spaced around said assembly and adapted to extend and retract radially with respect to said axis to impart a radial forging action to said assembly as said assembly passes through said forging box.

* * * * *